US005683145A

United States Patent [19]

Boucherie

[11] Patent Number: 5,683,145

[45] Date of Patent: Nov. 4, 1997

[54] BRUSH FINISHING MACHINE AND A METHOD OF PROFILING TOOTHBRUSH BRISTLE TUFTS

[75] Inventor: Bart Gerard Boucherie, Izegem, Belgium

[73] Assignee: G.B. Boucherie N.V., Belgium

[21] Appl. No.: 511,467

[22] Filed: Aug. 4, 1995

[51] Int. Cl.[6] ..... A46D 1/06

[52] U.S. Cl. ..... 300/2; 300/21

[58] Field of Search ..... 300/2–11, 21; 15/167.1; 407/23, 24, 27, 28, 29; 83/869, 875; 264/243

[56] References Cited

U.S. PATENT DOCUMENTS

| | | | |
|---|---|---|---|
| 5,020,551 | 6/1991 | Guerret | 300/21 X |
| 5,143,425 | 9/1992 | Boucherie | 300/21 X |
| 5,390,984 | 2/1995 | Boucherie et al. | 300/21 |
| 5,454,626 | 10/1995 | Schiffer et al. | 300/21 |

FOREIGN PATENT DOCUMENTS

| | | | |
|---|---|---|---|
| 2251293 | 6/1975 | France | 300/21 |

*Primary Examiner*—Mark Rosenbaum

*Attorney, Agent, or Firm*—Sixbey, Friedman, Leedom & Ferguson, P.C.; Gerald J. Ferguson, Jr.; Tim L. Brackett, Jr.

[57] ABSTRACT

A toothbrush finishing machine and method are provided for producing toothbrushes with profiled, or contoured, patterns of bristle tufts. The bristles are selectively trimmed to different lengths using successively a plurality of different rotating cutting devices which each have a substantially cylindrical cutting surface with an axial gap therein. The axial gap of each preceding cutting device is wider than the corresponding axial gap of a succeeding axial device. Each rotating cutting device is followed by a rounding device provided for rounding the free end of the bristles. Each rounding device has deflecting members to selectively deflect bristles other than those trimmed in the preceding trimming step, so that the trimmed bristles have their ends projecting beyond the deflected bristles. The projecting bristle ends are engaged by the rounding device to be rounded.

5 Claims, 2 Drawing Sheets

BRUSH FINISHING MACHINE AND A METHOD OF PROFILING TOOTHBRUSH BRISTLE TUFTS

The present invention relates to a brush finishing machine, in particular to a brush finishing machine for profiling bristle patterns of toothbrushes, and to a method of profiling toothbrush bristle tufts.

Basically, two methods of profiling, or contouring, bristle tufts have been proposed in the prior art. According to the first method, a rotating cutter is used which has a cutting surface corresponding in shape to the profile to be produced. These cutting tools are expensive both in manufacture and in maintenance, such as sharpening. Also, since the cut bristle ends are angled instead of being flat due to the profiled cutting surface, the required rounding operation cannot be performed with an optimum result. For these reasons, this straightforward profiling technique has been largely abandoned in favour of the second method wherein bristles are selectively exposed to a rotating cutter, so that a cutter can be used which has a generally cylindrical, continuous cutting surface. Selective exposure of bristles to be trimmed is achieved by deflecting bristles other than those to be trimmed to a level lower than the free ends of the bristles to be trimmed. Depending on the particular contour of the bristle pattern to be achieved, however, this technique requires the use of deflecting members manufactured to narrow tolerances. For producing complex contours or profiles, some of the deflecting members must be very narrow, and yet of high mechanical strength.

The present invention provides a brush finishing machine and method wherein a rotating cutting device with a generally cylindrical cutting surface can be used and no deflecting members are required for selectively trimming bristles to different lengths.

In particular, the present invention provides a brush finishing machine which comprises a plurality of succeeding finishing stations for profiling bristle tufts and indexing means for successively moving brushes through the finishing stations. The finishing stations comprise at least one bristle trimming station with at least two generally cylindrical rotating cutters which are mounted on a common shaft in an axially spaced relationship to define an axial gap therebetween. Thus, since there is an axial gap between the rotating cutters, only bristles outside of the gap are cut by the rotating cutters. To produce a bristle pattern profile with groups of tufts tapering towards the free ends of the bristles, a plurality of trimming stations is used, and each succeeding trimming station has a gap between the rotating cutters which is narrower than a corresponding gap in the preceding trimming station. The contour thus produced is a stepped contour. The steps of this contour, however, can be perfectly levelled by the usual rounding of the trimmed bristle ends. In fact, the bristle ends are all trimmed with perfectly flat ends, which is a prerequisite for an optimum rounding result.

Preferably, each trimming station is followed by a rounding station with a rotating rounding tool. The rounding station has at least one bristle deflecting member for selectively deflecting bristles other than those trimmed in the preceding station, so that the trimmed bristles have their ends projecting beyond deflected bristles to be engaged by the rounding tool, and rounded by a grinding operation, for example. Thus, deflecting members are used, but for the purpose of rounding the bristle ends. These deflecting members must not be manufactured to narrow tolerances. In fact, their width is preferably selected slightly smaller than that of the axial gap between the rotating cutters to insure that all bristles trimmed in the preceding trimming step will have their ends exposed to the rounding tool. Some bristles other than those trimmed in the preceding trimming step may not be deflected so that they are likewise exposed to the rounding tool. These long bristles may be damaged by the rounding tool, but this is of no significance since they will be cut in the succeeding trimming step.

The present invention further provides a method of profiling toothbrush bristle tufts by trimming bristles to different lengths using successively at least two different rotating cutting devices which each have a substantially cylindrical cutting surface with an axial gap therebetween, and the axial gap of each preceding cutting device is wider than the axial gap of the respective succeeding cutting device. Preferably, each trimming step is followed by a rounding step, wherein bristles other than those trimmed in the preceding trimming step are selectively deflected, so that the trimmed bristles have their ends projecting beyond the deflected bristles, and wherein the projecting bristle ends are engaged by a rounding tool to be rounded thereby. The method can be performed in a stepped sequence, by indexing the brushes through alternating trimming and rounding stations.

Further features and advantages of the invention can be taken from the following description of a preferred embodiment with reference to the drawings. In the drawings.

Figure 1:
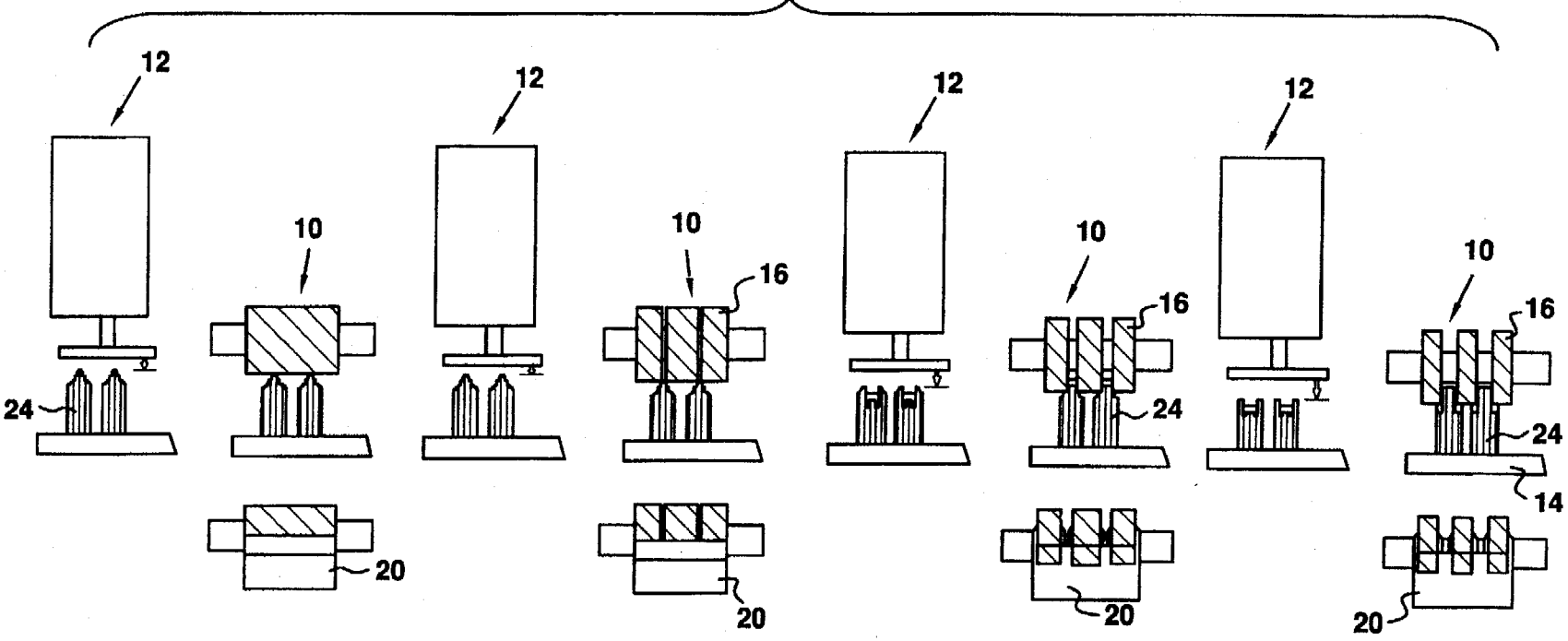
FIG. 1 is a diagramatic view of a brush finishing machine with alternating bristle trimming and grinding stations.

The brush finishing machine illustrated in FIG. 1 is a toothbrush profiling machine. The machine comprises four bristle trimming stations 10 and four rounding stations 12. The trimming stations 10 selectively trim bristles of toothbrushes 14 to different lengths to create a bristle pattern profile consisting of groups of bristle tufts tapering in the direction of their free ends. The toothbrushes 14 are successively indexed, e.g. by a chain drive, through the stations 10 and 12.

A particular one of the trimming stations 10 will now be described in more detail with reference to FIG. 2.

Figure 2A:
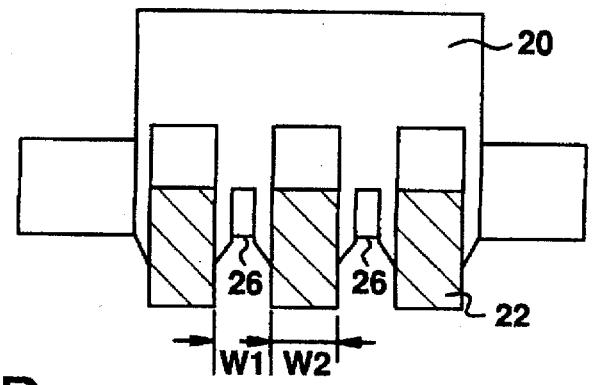
FIG. 2 is a schematic side view of a trimming device comprising generally cylindrical rotating cutters and an associated cutting blade.
Figure 2B:
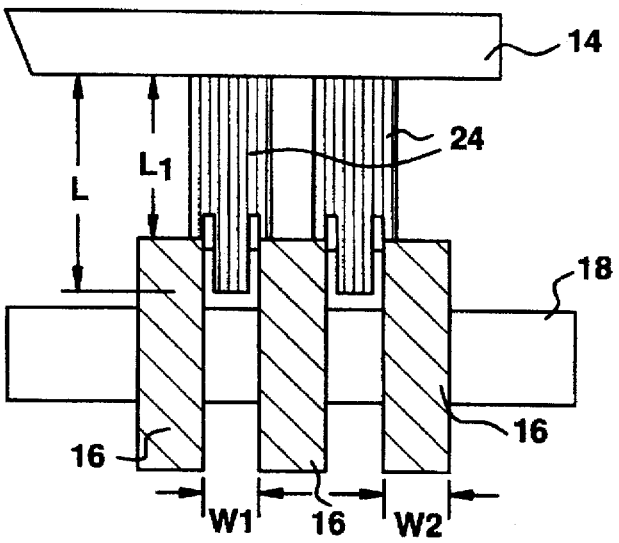

The trimming station shown in FIG. 2 comprises a cutting device which consists of three generally cylindrical rotating cutters 16 mounted on a common shaft 18 and of an associated cutting blade 20. The rotating cutters 16 are axially spaced from each other, defining an axial gap of a width $W_1$ therebetween. Likewise, the cutting blade 20 has three blade portions 22 in an axially spaced relationship, the axial gap between the blade portions 22 having the same width $W_1$ as the axial gap between the rotating cutters 16. Of course, the width of the rotating cutters 16, $W_2$ is identical to the width $W_2$ of the blade portions 22.

For clarity, the cutting blade is shown separate from the rotating cutters 16. In use, the blade portions 22 have their cutting edges adjacent the periphery of the associated rotating cutters 16.

As further seen in FIG. 2, brush 14 has a number of groups 24 of bristle tufts, only two of which are shown in the drawings. Each group 24 of bristle tufts is wider than the axial gap $W_1$, and the axes of the groups 24 are centrally aligned with the gaps between the rotating cutters 16. The length of the bristles in the tuft group 24 is L and the spacing between the base of brush 14 and the periphery of the rotating cutters 16 is $L_1$, which is smaller than L. Thus, it is clear that those bristles in the tuft groups 24 which engage the periphery of the rotating cutters 16, will be trimmed to a length $L_1$. All other bristles will remain at the length L.

As is seen in FIG. 2, the cutting blade 20 is provided between the blade portions 22 with a funnel-shaped guiding structure 26 terminating in a slot, so that the bristles other than those to be trimmed by the rotating cutters 16 will be held slightly axially spaced from the sides of these cutters.

Referring again to FIG. 1, the trimming station 10 at the right-hand end of the drawing could be similar to that just described with reference to FIG. 2. In this particular trimming station, which is the first station of the machine, the width $W_2$ of the rotating cutters 16 is similar to the width $W_1$ of the axial gaps therebetween. In this trimming station 10, the groups 24 of bristle tufts are trimmed to a stepped profile, with only one relatively large step on each side.

In the second trimming station 10 in FIG. 1, the width $W_1$ of the axial gaps between the rotating cutters 16 is substantially smaller than the width $W_2$ of the cutters 16. In addition, the spacing between the base of the brush 14 and the periphery of the rotating cutters 16 is larger than the corresponding spacing in the preceding trimming station. Therefore, those bristles not trimmed in the preceding step, and engaged by the rotating cutters 16 of the particular trimming station, are trimmed, creating a second, smaller step in the sides of the groups 24 of bristles.

In each following trimming station 10, the axial gap between the rotating cutters 16 is smaller than the corresponding gap in the preceding trimming station. Simultaneously, the spacing between the base of the brush 14 and the periphery of the rotating cutters 16 is larger than the corresponding spacing in the preceding trimming station. Therefore, an additional, even smaller, step is formed in the group 24 of bristle tufts by each following trimming station.

In the machine shown in FIG. 1, a final trimming station 10, shown on the left-hand side of the drawing has a single, generally cylindrical rotating cutter with a continuous cylindrical cutting surface to trim the ends of the remaining bristles.

Figure 3:
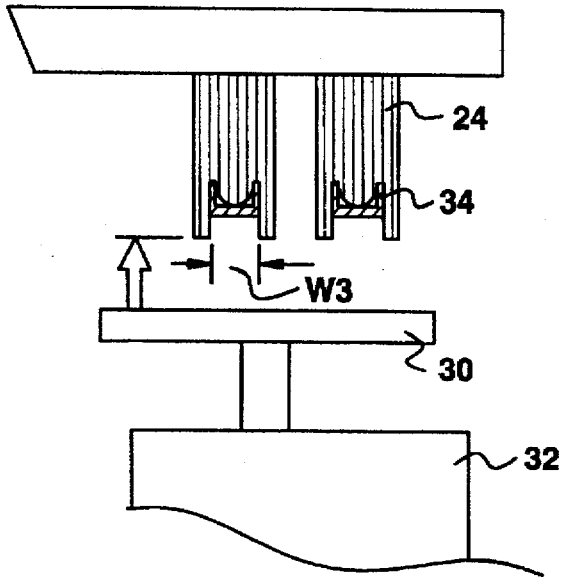
FIG. 3 is a schematic side view of a grinding device.

As mentioned before, each trimming station 10 is followed by a rounding station 12. One of the rounding stations 12 is shown in FIG. 3 in more detail.

The rounding station essentially consists of a rounding tool with a rotating grinding disk 30 and a rotatory drive 32, and of a number of deflecting members 34 corresponding to the number of tuft groups 24 to be profiled. Each deflecting member 34 is generally channel-shaped, so that when the deflecting member is moved into a group 24 of tufts, bristles are entrapped between the channel sides and abut the bottom of the channel, so that they are finally deflected. The deflecting members can be conventional, as shown in U.S. Pat. No. 5,143,425, for example, incorporated herein by reference. The width $W_3$ of each deflecting member 34 is slightly smaller than the width $W_1$ of the axial gap between the rotating cutters 16 in the preceding trimming station to ensure that no bristles trimmed in the preceding trimming step will be deflected. These trimmed bristles have their free ends projecting beyond the deflecting members 34 to be engaged by the grinding disk 30, so that their free ends will be rounded. Since the width $W_3$ is slightly smaller than the width $W_1$, some longer bristles can be simultaneously engaged by the grinding disk 30 and these bristles will be damaged. This is not significant, however, since these bristles will be trimmed in the next trimming step.

Referring again to FIG. 1, it is seen that the deflecting members 34 in each rounding station 12 have a width corresponding to the width of the axial gap between the rotating cutters of the preceding trimming station, i.e. the width is slightly smaller than that of the axial gap. Obviously, the last rounding station 12 on the left-hand end of the drawing is not provided with deflecting members since the tips of the profiled tuft groups 24 are rounded here.

As apparent from the preceding disclosure, the only deflecting members required are those of the rounding stations 12. Manufacture of these deflecting members is uncritical since their width must not be closely matched to the particular tuft pattern to be created. The resulting tuft pattern will be governed by the axial gaps between the rotating cutters of the different trimming stations and by the different spacings between the brush base and the periphery of the rotating cutters, and also by the number of trimming stations used. The rotating cutters can be easily manufactured and sharpened since they have cylindrical cutting surfaces.

Although the particular profiles, or contours, of tuft groups created by the machine and method of the present invention are inherently stepped, a sufficiently smooth transition between the steps can be insured by using a sufficient number of trimming stations so that the height-differential between successive steps is small. If the steps are small, such as achieved by as many as ten trimming stations, for example, it is not required to have each trimming station followed by a rounding station. Rather, every second trimming station is followed by a rounding station. Since all bristles are trimmed with perfectly flat ends, a good rounding result is achieved even when the bristles operated upon are of a slightly different length. Thus, high quality profiled toothbrushes can be produced with a reduced number of rounding stations.

According to yet another embodiment not shown in the drawings, the rounding stations are separate from the trimming stations. The trimming stations follow each other, and the rounding stations are sequentially arranged in a different portion of the finishing machine.

I claim:

1. A brush finishing machine comprising a plurality of succeeding finishing stations for profiling bristle tufts and indexing means for successively moving brushes through said finishing stations, said finishing stations comprising a plurality of bristle trimming stations, each of said trimming stations having at least two generally cylindrical rotating cutters mounted on a common shaft in an axially spaced relationship to define an axial gap therebetween, and each trimming station following a preceding trimming station having an axial gap between said rotating cutters which is narrower than a corresponding axial gap in said preceding trimming station, thereby cutting bristles to a greater length than said preceding trimming station.

2. The machine of claim 1, wherein said trimming stations comprise a final trimming station with a rotating cutter which has a continuous cylindrical cutting surface.

3. The machine of claim 1, wherein each trimming station comprises a cutting blade cooperating with said rotating cutters and having a cutting edge with a gap aligned with said axial gap between said rotating cutters.

4. The machine of claim 3, wherein at least some of said trimming stations are followed by a rounding station with a rotating rounding tool and at least one bristle deflecting member for selectively deflecting bristles other than those trimmed in a preceding trimming station so that trimmed bristles have their ends projecting beyond deflected bristles to be engaged by said rounding tool.

5. The machine of claim 4, wherein said deflecting member has a width slightly smaller than that of said axial gap between said rotating cutters.

* * * * *